US006031324A

United States Patent [19]

Itaya et al.

[11] Patent Number: 6,031,324

[45] Date of Patent: Feb. 29, 2000

[54] ANNULUS FLUORESCENT LAMP

[75] Inventors: Kenji Itaya; Takeshi Matsumura, both of Osaka, Japan

[73] Assignee: Matsushita Electric Industrial Co., Ltd., Osaka, Japan

[21] Appl. No.: 09/049,185

[22] Filed: Mar. 27, 1998

[30] Foreign Application Priority Data

Mar. 31, 1997 [JP] Japan ..... 9-079492
Jan. 14, 1998 [JP] Japan ..... 10-005616

[51] Int. Cl.[7] ..... H01K 1/24

[52] U.S. Cl. ..... 313/318.02; 313/493; 362/373; 362/260

[58] Field of Search ..... 313/493, 318.02, 313/216; 362/260, 264, 294, 368, 373

[56] References Cited

U.S. PATENT DOCUMENTS

| | | | |
|---|---|---|---|
| 3,858,162 | 12/1974 | Mai et al. | 339/145 D |
| 4,468,071 | 8/1984 | Bradley et al. | 339/50 |
| 5,034,655 | 7/1991 | Murayama et al. . | |
| 5,105,118 | 4/1992 | Shinada et al. | 313/51 |
| 5,723,939 | 3/1998 | Okuno et al. | 313/493 |
| 5,789,849 | 8/1998 | Porembski et al. | 313/318.02 |

FOREIGN PATENT DOCUMENTS

| | | |
|---|---|---|
| 0 720 208 | 7/1996 | European Pat. Off. . |
| 6-203798 | 7/1994 | Japan . |
| 8-241669 | 9/1996 | Japan . |

OTHER PUBLICATIONS

Aug. 14, 1998 Communication from European Patent Office and attached Search Report.

*Primary Examiner*—Vip Patel
*Assistant Examiner*—Matthew J. Gerike
*Attorney, Agent, or Firm*—Merchant & Gould, P.C.

[57] ABSTRACT

An annulus fluorescent lamp comprises a plurality of annulus fluorescent tubes having different diameters and disposed substantially concentrically in substantially the same plane. Each of the annulus fluorescent tubes has a first end with electrodes and a second end without electrodes. The second ends of the annulus fluorescent tubes are communicated with each other via a bridge portion so that a single discharge path is formed inside the plurality of annulus fluorescent tubes. The annulus fluorescent lamp also comprises a mouthpiece covering the first and second ends of the annulus fluorescent tubes. The second end forms the lowest temperature portion. The mouthpiece is provided with through holes for ventilation close to the second end and an insulating wall on an inner face for separating power lines at the first ends from the through holes for ventilation.

6 Claims, 7 Drawing Sheets

ANNULUS FLUORESCENT LAMP

BACKGROUND OF THE INVENTION

This invention relates to an annulus fluorescent lamp that comprises a plurality of fluorescent tubes having different diameters and communicated with each other at a bridge portion.

It is known that if a temperature of the lowest temperature point of a fluorescent tube rises along with an ambient temperature during operation, a mercury vapor pressure in the fluorescent tube rises and lamp luminosity and luminescence efficiency decrease. Especially, in the annulus fluorescent tube, an electrode portion at an end of the tube and the lowest temperature portion at another end of the tube are close to each other, so that heat generated at the electrode portion is easily transferred to the lowest temperature portion and raises the temperature at the lowest temperature portion.

To solve the above-mentioned problem, it is proposed to form through holes in a mouthpiece that covers both ends of the fluorescent tube for controlling the temperature of the lowest temperature portion during operation and improving the luminosity as disclosed in Japanese laid-open patent application (Tokukai-Hei) 8-241669.

However, the above-mentioned configuration has a problem. If a metal piece or other small object enters inside of the mouthpiece via the through hole, power lines such as exposed electric wires connected to the electrodes may be short-circuited. Even if the through holes are small independent holes as disclosed in the above-mentioned document, such exposure of the power lines cannot be prevented completely.

Particularly, a double annulus fluorescent lamp needs such through holes in the mouthpiece for ventilation to suppress a temperature rise at the lowest temperature portion, since it is operated under a large load condition and has a tendency that the temperature at the lowest temperature portion rises easily. Therefore, the problem of the exposed power lines, that is a lack of insulation, may possibly occur.

SUMMARY OF THE INVENTION

An object of the present invention is to prevent the exposure of the power line in the mouthpiece of the annulus florescent lamp and ensure their insulation.

Another object of the present invention is to control the temperature at the lowest temperature portion of the annulus fluorescent lamp so as to improve lamp luminosity and luminescence efficiency while operating at a high ambient temperature.

An annulus fluorescent lamp of the present invention comprises a plurality of annulus fluorescent tubes having different diameters and disposed substantially concentrically in substantially the same plane. Each of the annulus fluorescent tubes has a first end with electrodes and a second end without electrodes, the second ends of the annulus fluorescent tubes being communicated with each other via a bridge portion so that a single discharge path is formed inside the plurality of annulus fluorescent tubes. A mouthpiece covers the first and second ends of the annulus fluorescent tubes, the second ends forming the lowest temperature portions, the mouthpiece being provided with through holes for ventilation close to the second portion. An insulating wall is provided at an inner face of the mouthpiece for separating power lines of the electrodes of the first ends from the through holes for ventilation.

According to this configuration, the insulating wall defines the space that includes power lines and the space that communicates with the outside of the mouthpiece via through holes. Even if the power lines are long and flexible, the shielding wall securely prevents the power lines from being exposed through the through holes.

It is preferable that the inner face of the mouthpiece has a holder (e.g., a rib) that holds the annulus fluorescent tube at a portion close to the second end. This holder restricts the position of the lowest temperature portion of the annulus fluorescent tubes in the mouthpiece, so that a variation of the temperature at the lowest temperature portions of the annulus fluorescent tubes, as well as variation of the lamp luminosity, becomes small.

DETAILED DESCRIPTION OF THE PREFERRED EMBODIMENTS

Figure 1:
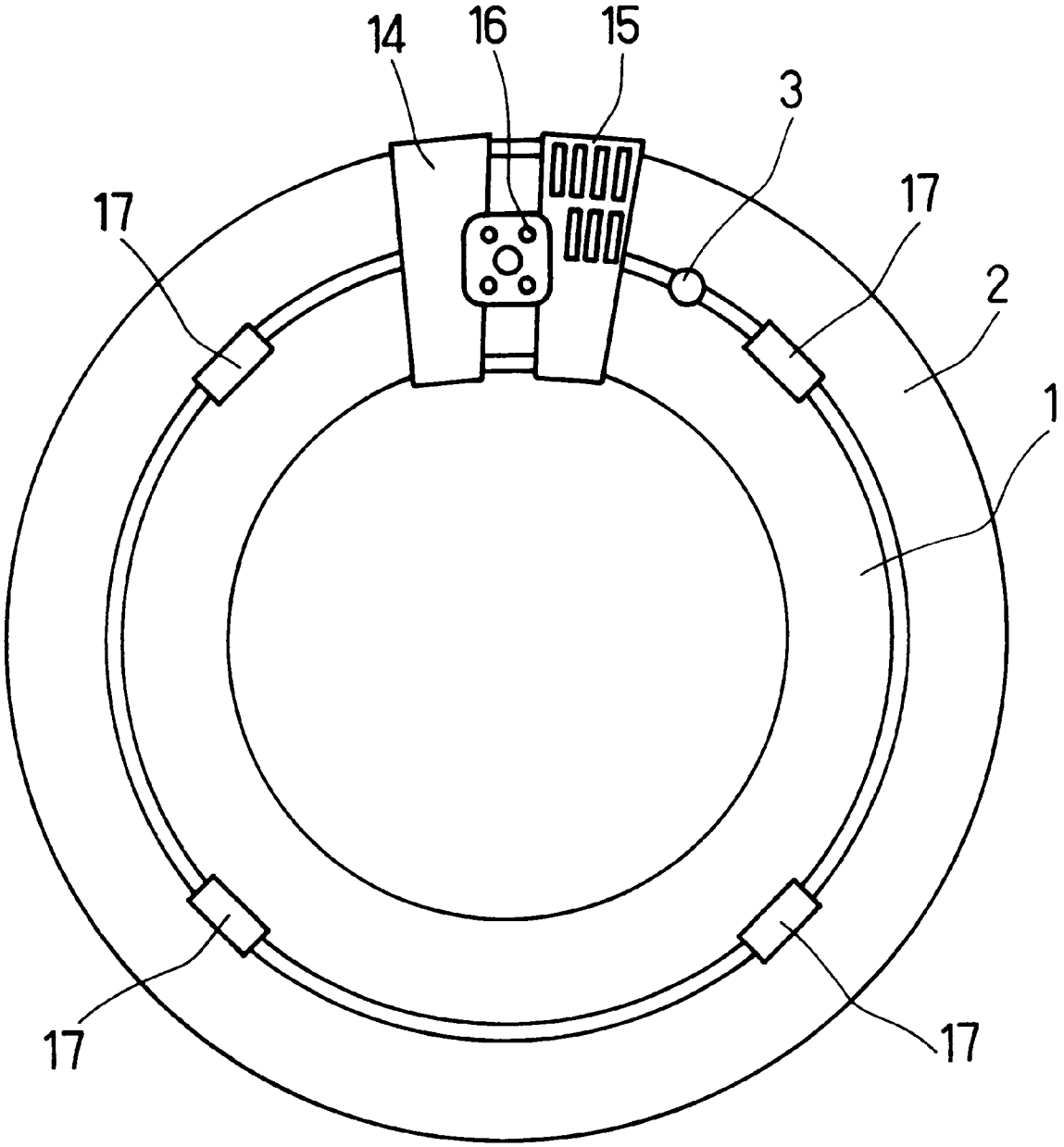
FIG. 1 is a plan view of an annulus fluorescent lamp according to an embodiment of the present invention.
Figure 2:
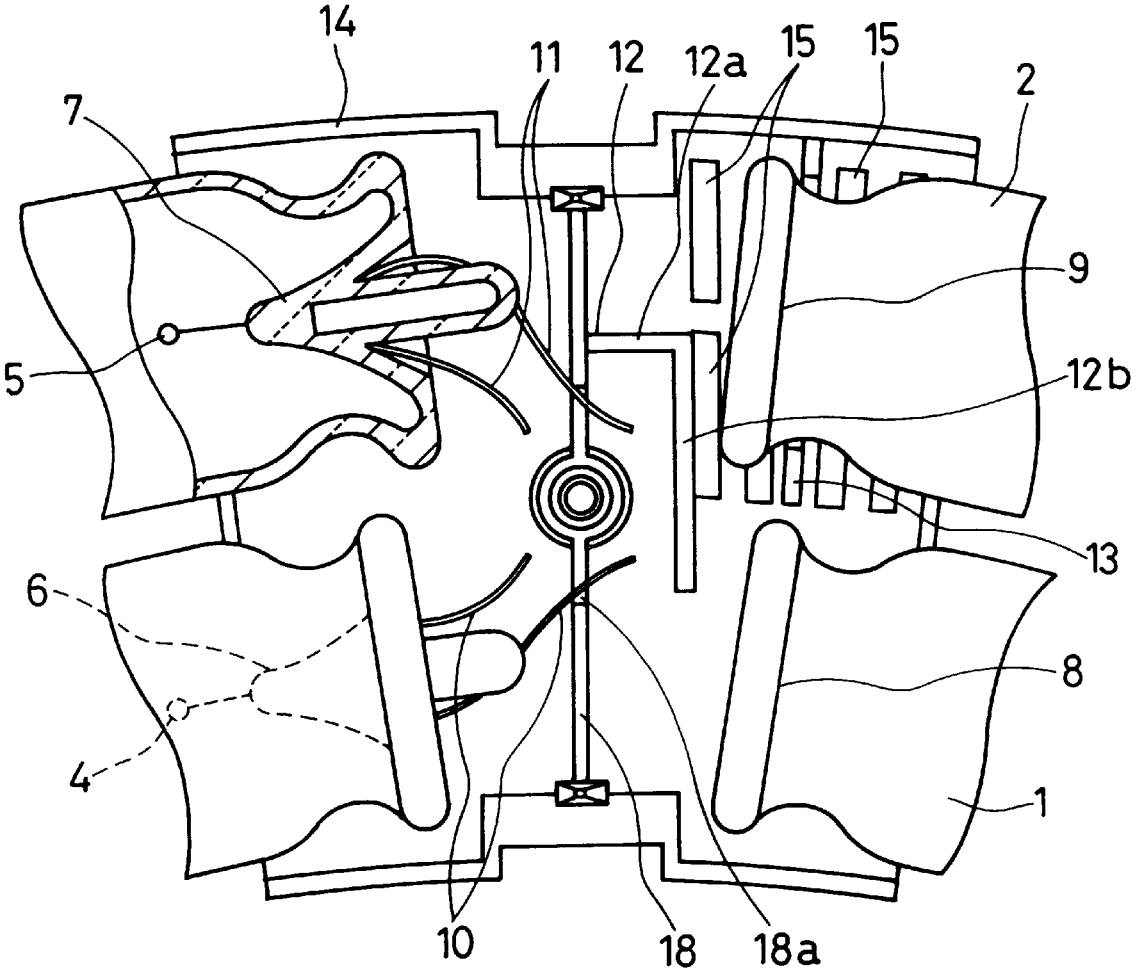
FIG. 2 is an inside plan view of a mouthpiece of the annulus fluorescent lamp shown in FIG. 1.

Referring FIGS. 1 and 2, an annulus fluorescent lamp according to an embodiment of the present invention comprises two annulus fluorescent tubes 1, 2 having different diameters and disposed substantially concentrically in substantially the same plane. Each of the annulus fluorescent tubes has a first end with electrodes and a second end without electrodes. The second ends of the two annulus fluorescent tubes are communicated with each other via a bridge portion 3. Thus, a single discharge path is formed inside two annulus fluorescent tubes 1, 2 that are made of glass.

The first ends of the annulus fluorescent tubes 1, 2 are closed with electrode seal portions 6, 7 that support electrodes 4, 5. The second ends of the annulus fluorescent tubes 1, 2 are closed with non-electrode seal portions 8, 9 that are glass stems without electrodes.

The inner surfaces of the annulus fluorescent tubes 1, 2 are coated with a rare-earth fluorescent material. Inside of the tubes 1, 2 are enclosed mercury and a noble gas such as argon or neon at 200–500 Pa for startup assistance gas. Instead of mercury, a zinc amalgam can be used.

The two annulus fluorescent tubes 1, 2 are fixed to each other at plural portions with a resin 17 such as a silicone.

Figure 3:
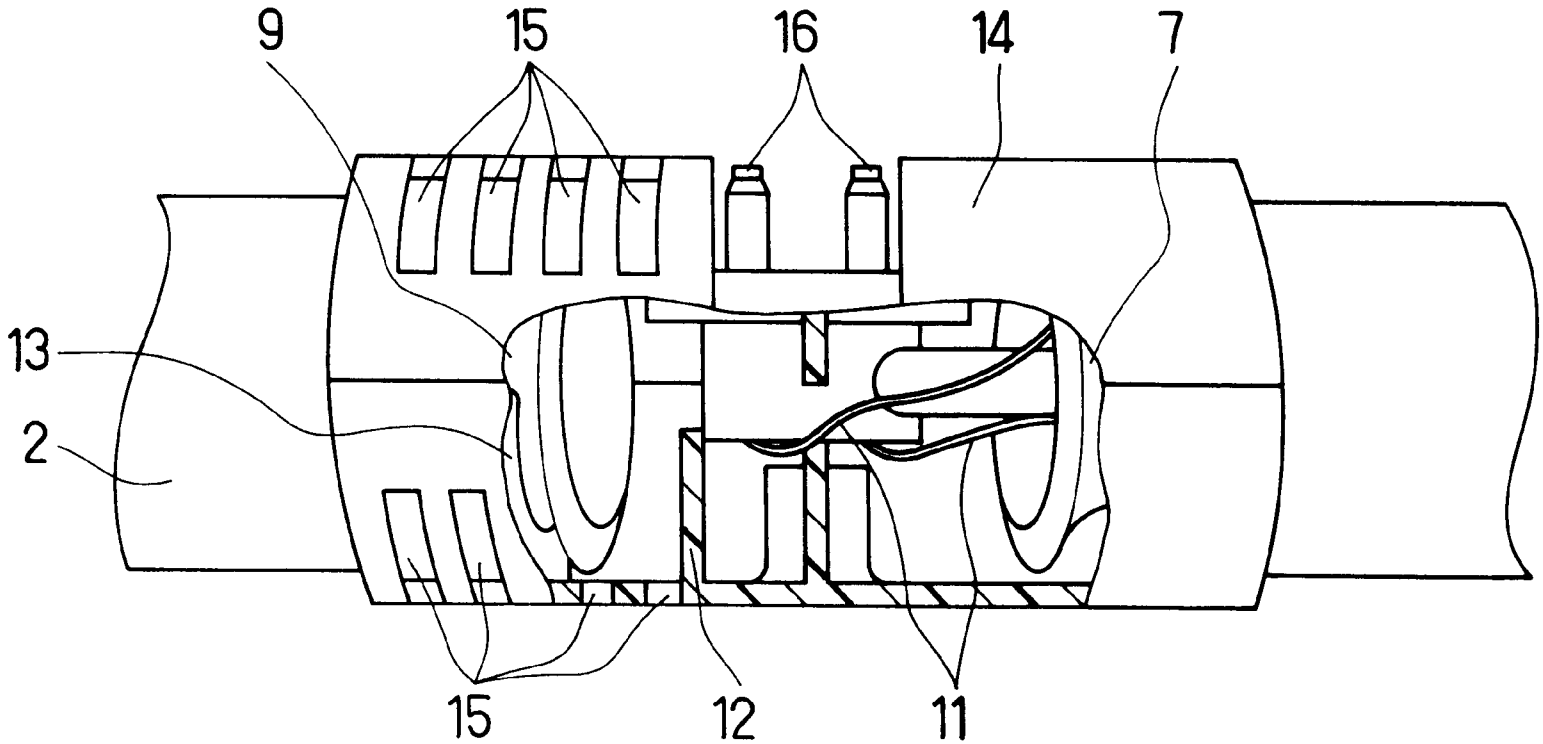
FIG. 3 is a partially sectioned elevation showing the inside of the annulus fluorescent lamp shown in FIG. 1.

The first and second ends of the annulus fluorescent tubes 1, 2 are covered with a mouthpiece 14 made of a plastic material such as polyethylene terephthalate (PET) or polybutylene terephthalate (PBT). The mouthpiece 14 includes an upper half and a lower half as shown in FIG. 3. The two halves are fixed to each other with a screw. The upper half of the mouthpiece is provided with four lead terminals 16. Each lead terminal 16 is a hollow pin in which one of power lines (i.e., outer lead wires) 10, 11 is inserted. The outer lead wire 10, 11 and the lead terminal 16 are welded at the tip of the terminal 16.

The structure of the mouthpiece will be explained in detail referring to FIG. 2. Each of the upper and lower halves of the mouthpiece 14 is provided with several slots (i.e., through holes) 15 for ventilation in the area where the second ends of the annulus fluorescent tubes are positioned. The inner face of the mouthpiece half 14 is provided with a heat shielding wall 18 as well as an insulating wall 12. The heat shielding wall 18 thermally separates the first ends (i.e., electrode seal portions) 6, 7 from the second ends (i.e., non-electrode seal portions) 8, 9 of the annulus fluorescent tubes 1, 2. The insulating wall 12 physically separates the power lines 10, 11 inside the mouthpiece from the slot 15 for ventilation. The insulating wall 12 defines the space that includes power lines 10, 11 and the space that communicates with the outside of the mouthpiece through the slots 15. The L-shaped insulating wall 12 includes a first portion 12*a* that branches from the heat shielding wall 18 and extends to the slot 15, and a second portion 12*b* that extends along and beyond the end of the slot 15 perpendicularly from the first portion 12*a*. The first and second portions 12*a*, 12*b* of the shielding wall 12 prevent the power lines 10, 11 from sticking out to the slots 15 for ventilation. Thus, even if the power lines 10, 11 are long and flexible, the two portions 12*a*, 12*b* of the shielding wall 12 securely prevent the power lines 10, 11 from sticking out into the slots 15. As a result, insulation of the fluorescent lamp is ensured. In addition, the appearance of the lamp is good since the power lines (wires) 10, 11 cannot be seen through the slot 15 for ventilation.

As shown in FIG. 2 and 3, the heat shielding wall 18 has a recess 18*a* in the middle portion, in which four outer lead wires (power lines) 10, 11 are placed to be gathered to the center of the mouthpiece 14.

The slots 15 for ventilation, in cooperation with the heat shielding wall 18, prevents an excessive temperature rise at the lowest temperature portion of the fluorescent tube as well as a rise of a mercury vapor pressure in the annulus fluorescent tube 1, 2, so that the lamp luminosity and luminescence efficiency are maintained.

Figure 4:
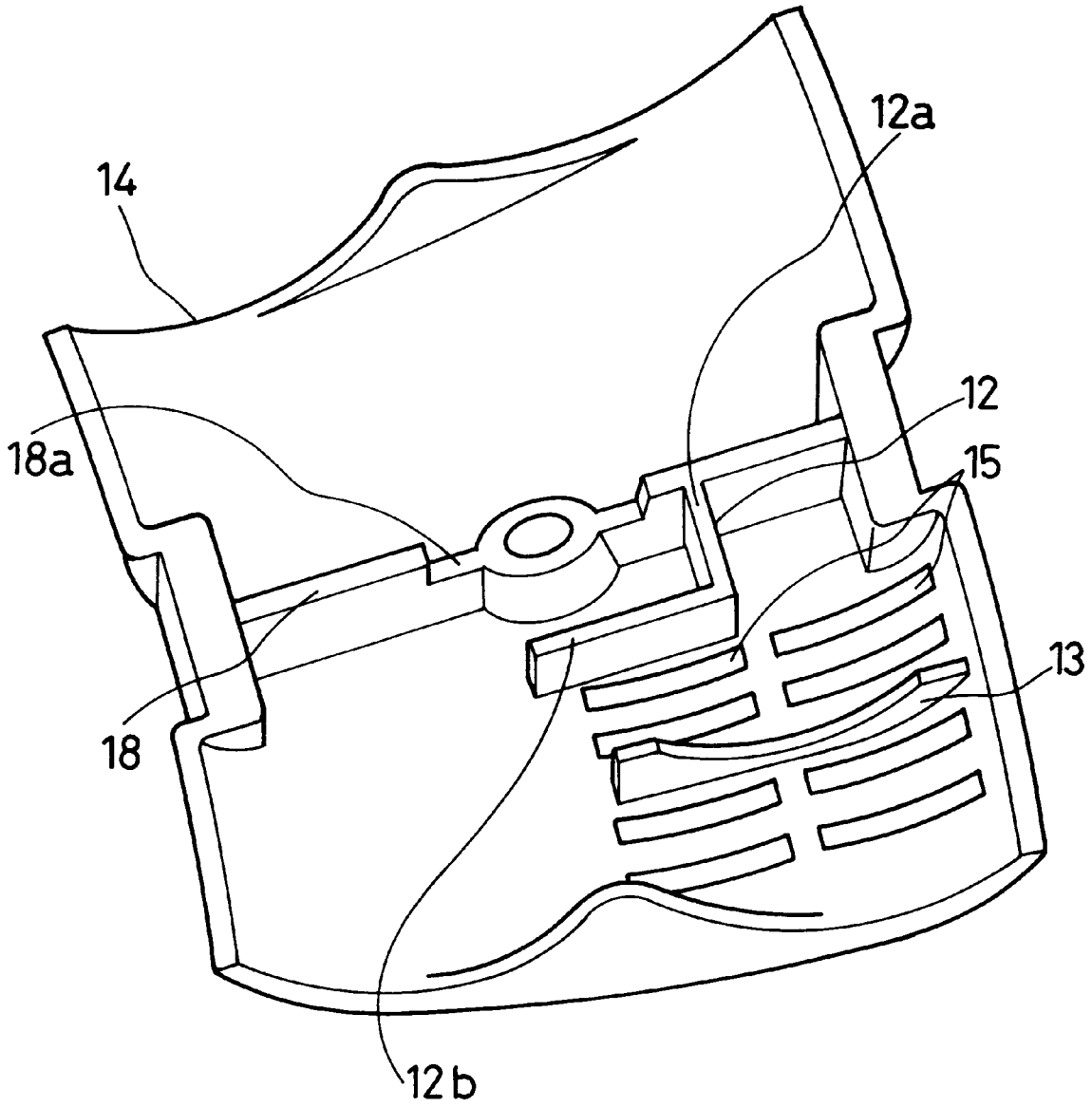
FIG. 4 is a perspective inner view of a mouthpiece half of the annulus fluorescent lamp shown in FIG. 1.

Moreover, as shown in FIG. 4, the inner face of the mouthpiece 14 has a rib 13 as a holder that holds the annulus fluorescent tube 2 at the non-electrode seal portion 9. The rib 13 has a concave contour with a radius a little larger than the thickness of the annulus fluorescent tube 2 at the constricted portion near the non-electrode seal portion 9. The rib 13 holds the constricted portion of the annulus fluorescent tube 2, so that misregistration between the annulus fluorescent tubes 1, 2 and the mouthpiece 14 is restricted. Thus, since registration of the lowest temperature portion of the annulus fluorescent tubes 1, 2 and the slots 15 for ventilation is maintained, variation of a temperature at the lowest temperature portions of the annulus fluorescent tubes, as well as variation of the lamp luminosity, becomes small.

Figure 5:
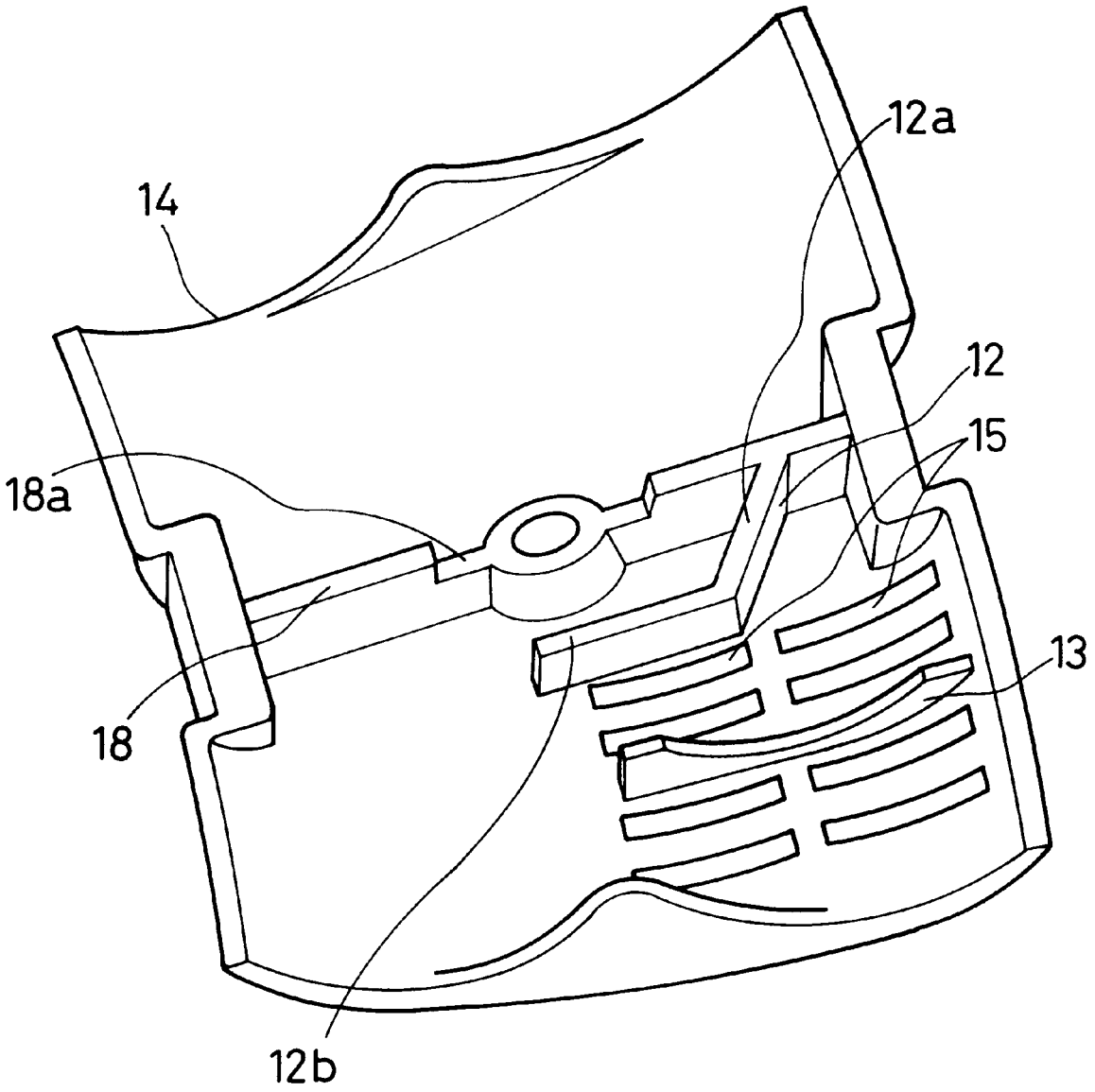
FIG. 5 is a perspective inner view of a mouthpiece half according to another embodiment.
Figure 6:
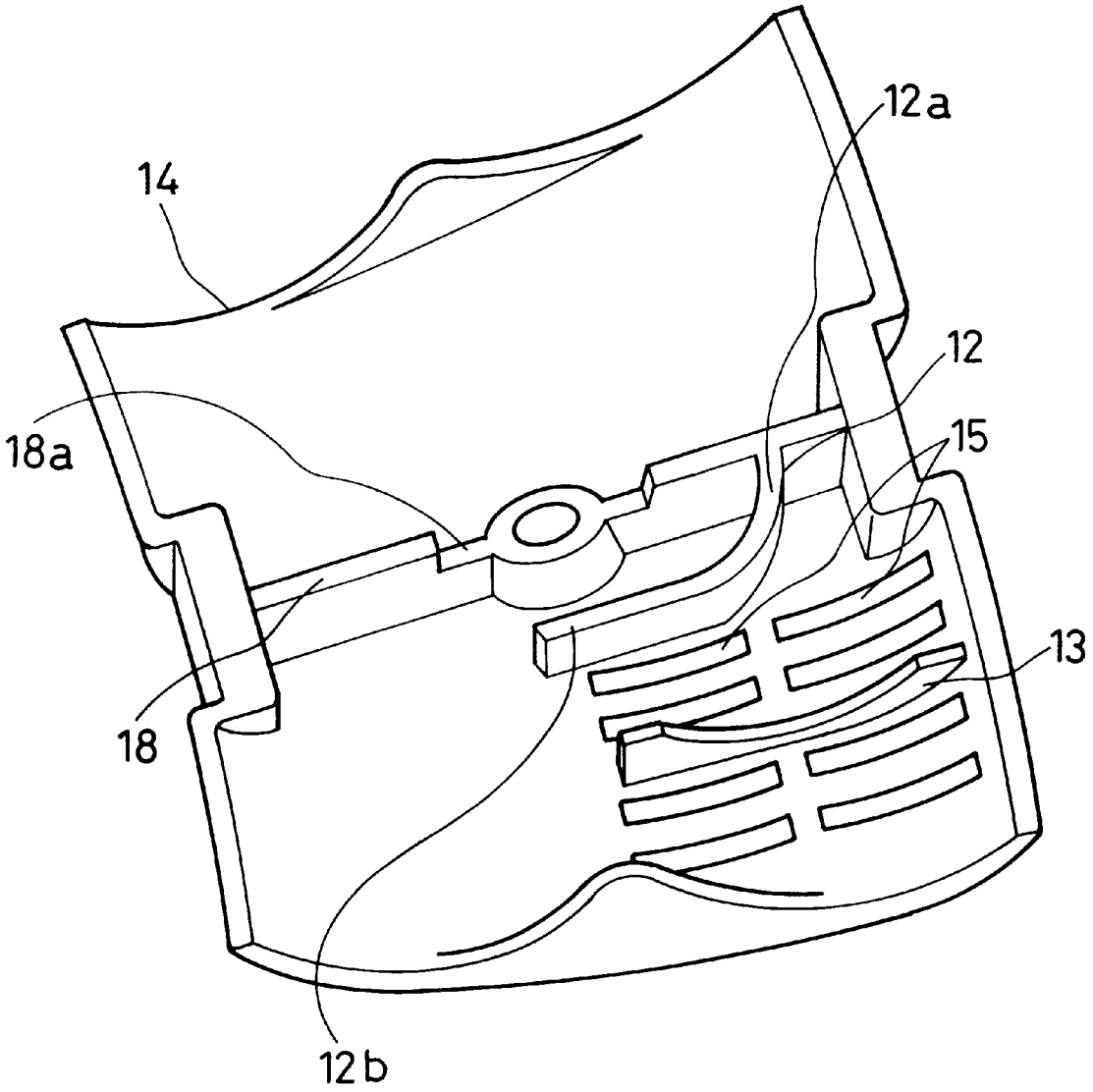
FIG. 6 is a perspective inner view of a mouthpiece half according to another embodiment.
Figure 7:
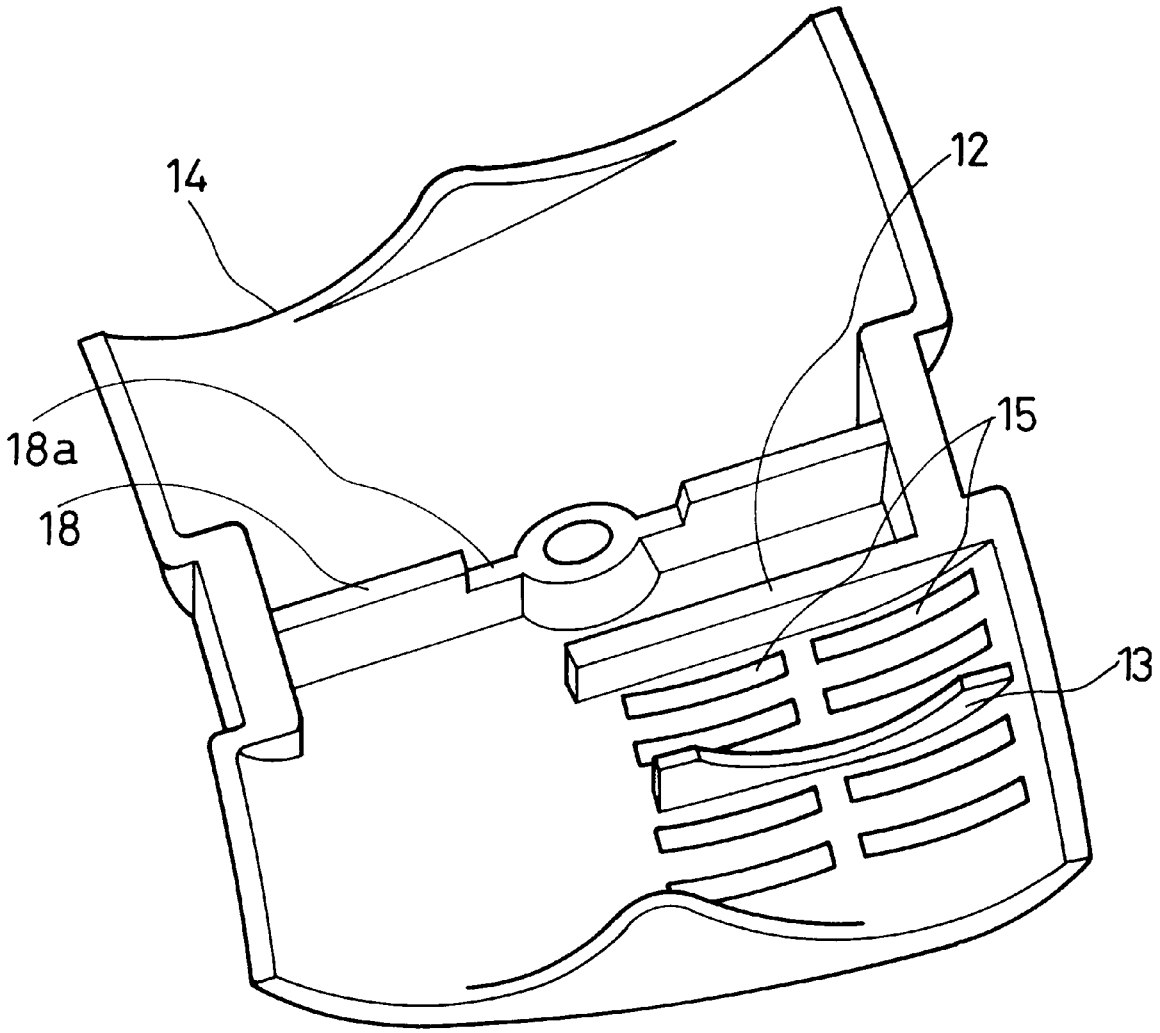
FIG. 7 is a perspective inner view of a mouthpiece half according to another embodiment.

Instead of the L-shaped wall, the insulating wall 12 may be as shown in FIG. 5, which includes a first portion 12*a* that branches from the heat shielding wall 18 and extends toward the slot 15 on the slant, and a second portion 12*b* that extends along and beyond the end of the slot 15 in the obtuse angle from the first portion 12*a*. Another embodiment of the insulating wall 12 is shown in FIG. 6 or 7. The insulating wall 12 in FIG. 6 includes a first portion 12*a* that branches from the heat shielding wall 18 and curves in the direction along the slot 15, and a second portion 12*b* that extends along and beyond the end of the slot 15. The insulating wall 12 in FIG. 7 has a single linear portion that extends along and beyond the end of the slot 15 from the edge of the mouthpiece half 14.

In an example, an annulus fluorescent lamp rated 40 watts according to the present invention has the following dimensions: the tube diameter of the annulus fluorescent tubes 1, 2 is 20 millimeters; the outer shape diameter of the outer annulus tube 2 is 200 millimeters; the inner shape diameter of the inner annulus tube 1 is 114 millimeters; and the distance between the annulus fluorescent tubes 1, 2, i.e., the length of the bridge portion 3, is approximately 3 millimeters.

In FIG. 4, the thickness and height of the insulating wall 12 are 1.0 millimeter and 10 millimeters, respectively; the lengths of the first and second portions 12*a*, 12*b* are 12 millimeters and 6 millimeters, respectively; the thickness of the heat shielding wall 18 is 1.0 millimeter; and the length and depth of the recess 18*a* are 14 millimeters and 5 millimeters, respectively.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, and all changes that come within the meaning and range of equivalency of the claims are intended to be embraced therein.

We claim:

1. An annulus fluorescent lamp, comprising:

a plurality of annulus fluorescent tubes having different diameters and disposed substantially concentrically in substantially the same plane, each of the annulus fluorescent tubes having a first end with electrodes and a second end without electrodes, the second ends of the annulus fluorescent tubes being communicated with each other via a bridge portion so that a single discharge path is formed inside the plurality of annulus fluorescent tubes;

a mouthpiece covering the first and second ends of the annulus fluorescent tubes, the second ends forming the lowest temperature portions, the mouthpiece being provided with through holes for ventilation close to the second portion; and an insulating wall provided on an inner face of the mouthpiece for separating power lines of the electrodes of the first ends from the through holes for ventilation.

2. The annulus fluorescent lamp according to claim 1, wherein the inner face of the mouthpiece has a holder that holds at least one of the annulus fluorescent tubes at a portion close to the second end.

3. The annulus fluorescent lamp according to claim 1, wherein the insulating wall includes a first portion extending toward the through holes for ventilation, and a second portion connected to the first portion and extending along the electrode side of the through holes.

4. The annulus fluorescent lamp according to claim 3, wherein the inner face of the mouthpiece has a holder that holds at least one of the annulus fluorescent tubes at a portion close to the second end.

5. The annulus fluorescent lamp according to claim 1, wherein the insulating wall has a single linear portion that extends along the electrode side of the through holes.

6. The annulus fluorescent lamp according to claim 5, wherein the inner face of the mouthpiece has a holder that holds at least one of the annulus fluorescent tubes at a portion close to the second end.

* * * * *